United States Patent [19]

Tengler et al.

[11] Patent Number: 4,664,467

[45] Date of Patent: May 12, 1987

[54] COAXIAL CABLE TERMINATOR

[75] Inventors: John N. Tengler; Chris A. Shmatovich, both of Chico, Calif.

[73] Assignee: Minnesota Mining and Manufacturing Company, St. Paul, Minn.

[21] Appl. No.: 701,112

[22] Filed: Feb. 13, 1985

[51] Int. Cl.[4] ..... H01R 17/18

[52] U.S. Cl. ..... 339/177 R; 339/177 C

[58] Field of Search ..... 339/177, 143 R, 82, 339/83, 108 TP, 17 C

[56] References Cited

U.S. PATENT DOCUMENTS

| | | | |
|---|---|---|---|
| 3,335,388 | 8/1967 | Karol | 339/143 R |
| 3,408,610 | 10/1968 | Clarkson | 339/177 R |
| 3,781,763 | 12/1973 | Feeser et al. | 339/177 E |
| 4,088,385 | 5/1978 | Adkins | 339/177 E |
| 4,340,265 | 7/1982 | Ott et al. | 339/177 R |
| 4,397,516 | 8/1983 | Koren et al. | 339/177 R |
| 4,451,107 | 5/1984 | Dola et al. | 339/143 R |
| 4,453,796 | 6/1984 | Monroe | 339/177 R |
| 4,553,806 | 11/1985 | Forney, Jr. et al. | 339/177 R |

FOREIGN PATENT DOCUMENTS

| | | | |
|---|---|---|---|
| 122700 | 10/1984 | European Pat. Off. | 339/177 R |

*Primary Examiner*—Eugene F. Desmond

*Assistant Examiner*—David Pirlot

*Attorney, Agent, or Firm*—Renner, Otto, Boisselle & Lyon

[57] ABSTRACT

A miniature terminator for a miniature coaxial cable includes a center signal contact extending along an axial extent of the terminator, a second tubular sleeve contact coaxially positioned with respect to the signal contact and having an external contact surface for electrically connecting with an external member for grounding or shielding, a spacer for maintaining electrical isolation and spaced relation of the contacts, and a strain relief for mechanically securing the terminator to the coaxial cable. The terminator impedance substantially matches the impedance of the coaxial cable itself and this characteristic plus miniaturization help make the terminator appear physically and operationally as an extension of the coaxial cable. The invention also relates to a terminator system for coupling a plurality of coaxial cables terminated with respective terminators to further circuitry. The terminator system includes an electrically conductive plate-like member having plural openings therethrough for receiving and electrically engaging with the external contact surface of the second contact of each terminator thereby to couple the same to a common reference potential, such as ground reference potential.

21 Claims, 15 Drawing Figures

COAXIAL CABLE TERMINATOR

TECHNICAL FIELD

The invention relates generally, as indicated, to a terminator for a coaxial cable, especially a mini-coaxial cable, to a coaxial cable termination assembly, and to a terminator system for facilitating the terminating and electrical connecting of a plurality of coaxial cables having such terminators. Moreover, the invention relates to miniature impedance matching terminators for coaxial cables.

BACKGROUND

Coaxial cables frequently are used for high speed signal transmission and/or accurate signal/data transmission purposes in cases where it is desired to maintain a ground or reference potential isolation or shielding of the signal conductor and signals carried thereby. Often coaxial cables are used in circumstances that require relatively accurate impedance characteristics. For example, a coaxial cable may have a characteristic impedance of 50 ohms.

Prior terminators for subminiature coaxial cables generally have been unable substantially to match the impedance of the cable. Therefore, due to the rather different impedance characteristics at the terminator, the overall impedance characteristic of the cable may be altered and/or signal degradation may occur. Also, with the occurrence of such different impedance characteristics of the cable and terminator, accurate impedance matching with respect to circuitry to which the cable and terminator assembly is attached may not be possible.

Moreover, prior terminators for coaxial cables are relatively large in physical size. An example is a terminator referred to as a BNC connector. Such large terminators/connectors are unable to take advantage of the relative miniaturization of the coaxial cable adequate to carry certain signals. Thus, although the cable is miniaturized, the connector is so large that the number of cables capable of termination and connection to other circuits, terminals, etc. is severly limited.

With the increasing use of coaxial cables in electrical and electronic equipment, it has become all the more important to be able to couple many coaxial cables in a relatively small space, i.e. in a close-packed arrangement, in order to minimize space requirements for the equipment. Indeed, as is well known, there is constant striving to miniaturize electrical and electronic equipment. Compounding the difficulty in using many coaxial cables, especially mini-coaxial cables having cable diameters for example on the order of about 0.060", are the inability to terminate the same in a close-packed arrangement while maintaining integrity of connections, shielding, and impedance matching to maximize signal coupling and to minimize signal degradation.

SUMMARY

Several exemplary objects of the invention are expressed below.

One object is to terminate a coaxial cable, especially a mini-coaxial cable.

Another object is to terminate a coaxial cable while substantially matching impedance of the cable at the termination.

An additional object is to maintain the coaxial relationship of conductors in a coaxial cable terminator.

A further object is to miniaturize the size of a terminator for a coaxial cable, especially a mini-coaxial cable.

Still another object is to minimize the length of a coaxial cable terminator.

Still an additional object is to facilitate the connecting of a coaxial cable to a terminal or other external member, especially while maintaining substantially constant the impedance of the cable, minimizing ground path distance, and closely packing coaxial cable/terminal connections.

Still a further object is to terminate and to connect to terminals a plurality of mini-coaxial cables in close packed relation, especially while maintaining a high degree of ground signal isolation and impedance matching.

Yet another object is to effect impedance matching in a terminator for a coaxial cable, especially a mini-coaxial cable.

With the foregoing and the following detailed description in mind, then, one aspect of the invention relates to a terminator for a coaxial cable that has a pair of conductors, one being generally centered in the cable relative to the other, including a center contact for connecting between the generally centered conductor and an external terminal or member, a second contact for connecting between the other conductor and another external member, such as a metal plate providing a common connection for plural terminators, the second contact generally circumscribing the center contact along an axial extent of the terminator and having an external surface for electrically connecting with such another external member, e.g. conductive plate, a spacer for maintaining electrical isolation and spaced relation of the contacts, and a strain relief for mechanically securing the terminator to the coaxial cable.

Another aspect of the invention relates to a terminator for a coaxial cable of the type described in which a center contact connects between the center conductor and an external terminal or other member, a second contact for connecting between the other conductor to another external member, such as a metal plate, the second contact generally circumscribing the center contact along an axial extent of the terminator, a spacer for maintaining electrical isolation and spaced relation of the contacts, the spacer and contacts including cooperative portions that hold the same together while maintaining the contacts relatively spaced apart from each other, and a strain relief for mechanically securing the terminator to the coaxial cable.

An additional aspect of the invention relates to a terminator for a coaxial cable of the type described, the cable having a characteristic impedance, including a center contact for connecting between the centered conductor of the cable and an external terminal or other member, a second contact for connecting between the other cable conductor and another external terminal or member, such as a metal plate, the second contact generally circumscribing the center contact along an axial extent of the terminator, a spacer for maintaining electrical isolation and spaced relation of the contacts, the contacts and spacer being cooperatively interrelated substantially to match the impedance of the coaxial cable, and a strain relief for mechanically securing the terminator to the coaxial cable.

A further aspect of the invention relates to a coaxial cable termination assembly of such coaxial cable and terminator and to a terminator system for plural coaxial cables, especially mini-coaxial cables, which have terminators of the type described herein, the system including a means for mounting the terminators in close-packed relation with the second contact of each connected to a source of reference potential, for example being connected in common to a source of ground potential.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 2:
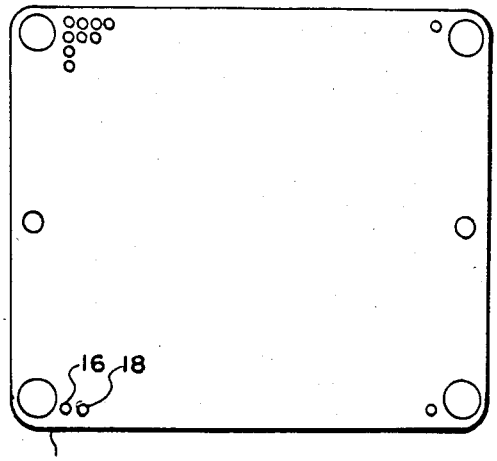
FIG. 2 is a top plan view of the terminator system of FIG. 1 looking generally in the direction of the arrows 2—2 of FIG. 1.
Figure 1:
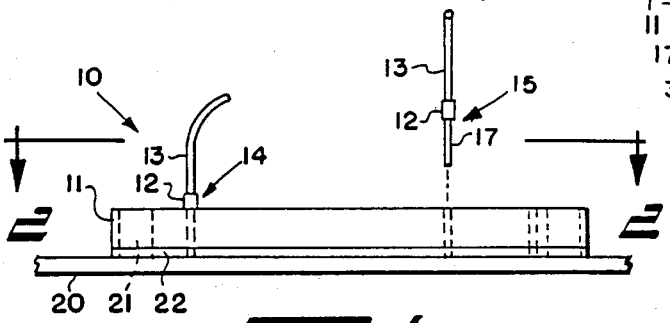
FIG. 1 is a side elevation view of a terminator system in accordance with the present invention.

Referring now in detail to the drawings, wherein like reference numerals designate like parts in the several figures, and initially to FIGS. 1 and 2, a terminator system in accordance with the present invention generally is designated 10. The system 10 includes a common electrically conductive member 11 intended to effect a common connection, for example to a source of ground reference potential or other reference potential, of a plurality of coaxial cable terminators 12, which are secured to respective coaxial cables 13. As is seen in FIG. 1, the terminator/cable assembly 14 already is positioned in the common electrically conductive member 11, and the terminator/cable assembly 15 is ready for insertion into the member 11 or has just been removed therefrom.

The member 11 preferably is an electrically conductive plate of aluminum or other electrically conductive material having adequate support characteristics and a plurality of terminator receiving openings 16 therein arranged in a relatively close-packed array, e.g. on 0.100 inch centers, to accommodate a relatively large number of terminators. Each terminator 12 preferably has an electrically conductive exterior contact surface 17 intended for wiping engagement and electrical connection with the member 11 at the interface thereof with the wall 18 of the member 11 bounding the interior of a respective opening 16. Preferably such wall 18 is generally cylindrical and the shape of the surface 17 is cylindrical; and the two are of a size that assures the desired electrical connection thereof when the terminator is inserted in the manner shown at the assembly 14 in FIG. 1.

Using the common electrically conductive member 11 to mount a plurality of the terminator and cable assemblies in the manner illustrated and described herein, it will be appreciated that a relatively large number of such assemblies may be mounted in a relatively small space thus achieving the desired close-packed positioning thereof according to the preferred embodiment of the invention. For example, the openings 16 may be close to each other to maximize the number of assemblies 14 that can be coupled to the member 11.

The terminator itself extends from the cable 13 parallel and continuous with the axial extent of the cable, and is of outside cross-sectional dimensions approximating those of the cable. Therefore, the terminator according to the invention does not solely limit the number of coaxial cable termination assemblies that can be close packed in a particular piece of electronic equipment. Also, due to the foregoing and to the impedance matching characteristics of the terminator vis-a-vis the cable and the coaxial contact arrangement in the terminator, the terminator appears physically and electrically substantially as a part of the cable itself.

Figure 3:
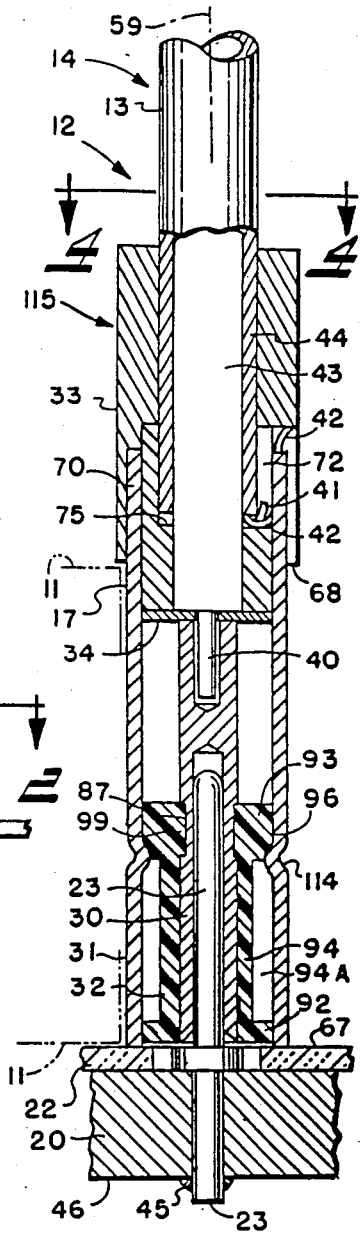
FIG. 3 is an enlarged side elevation section view of a coaxial cable terminator in accordance with the present invention.

The conductive plate 11 may be mounted on a printed circuit board 20 by fasteners (not shown) through screw holes 21 and may be spaced away from the printed circuit board by an appropriate insulator, spacer, etc., for example as is shown at 22 in FIG. 3. Such insulated spacing allows circuits or traces to be printed on the surface of the printed circuit board 20 facing the member 11. Mounted on the printed circuit board 20 is a plurality of electrically conductive pins or terminals represented at 23 in FIG. 3 which constitute respective external members or signal terminals to which respective assemblies 14, 15, etc. are intended for electrical connection. The printed circuit board 20 may be of conventional printed circuit board material having printed circuit traces thereon for connecting respective pins 23, ground paths, etc. to like pins, circuits, terminals, ground paths, on the printed circuit board and/or to further circuitry, connectors, etc. on, mounted with respect to, or otherwise electrically connected to the printed circuit board and/or circuits thereon. Preferably the thickness or height of the common electrically conductive member 11 above the printed circuit board 20 is adequate to help provide mechanical support for respective assemblies 14, 15, etc. and to help provide desired shielding of electrical signals and isolation of respective signals carried by respective assemblies 14, 15, as will become more apparent from the following description.

Turning now to FIG. 3, a coaxial cable termination assembly 14 formed of a coaxial cable terminator 12 coupled to a coaxial cable 13 according to the invention, is illustrated in detail. It is the function of the terminator 14 electrically and mechanically to terminate the coaxial cable 13 while maintaining a substantial matching of the cable impedance, for example of 50 ohms and minimizing space requirements to couple the cable termination assembly to another device, e.g. to the member 11 and pin 23.

Accordingly, the fundamental components of the terminator 14 include a center contact 30, also referred to as a signal contact, a second contact 31, also referred to as a circumscribing or shielding contact, a spacer 32, and a strain relief 33. A further washer insulator 34 also is part of the spacer portion of the terminator and is intended to provide an alignment/stop function and to help isolate the signal contact 30 from the contact 31 and part of the coaxial cable 13. The leading end or edge 34 of the terminator 14 is intended to be inserted into the opening 16 in the common electrically conductive member 11 and the opposite, other or back end of the terminator is proximate or at the strain relief. As is seen, the parts of the terminator 14 cooperate to present a physical and electrical appearance of a coaxial cable, and the small size causes the terminator to appear physically as a physical extension of the cable. As will become evident from the description below, the parts of the terminator also cooperate to match substantially the impedance characteristic of the cable 13. In the preferred embodiment described herein, the coaxial cable 13 is a conventional coaxial cable having a 50 ohm characteristic impedance. The characteristic impedance of the terminator 12 at various portions may range from on the order of about 30 to 35 ohms at one area to on the order of about 50 to 55 ohms at another area. Such impedances are relatively well matched to the 50 ohm coaxial cable impedance, especially in comparison to the unmatched terminators employed in the past.

The cable 13 includes a center conductor 40, also referred to as a signal conductor, which is located generally centrally relative to the axial or linear extent of the cable, and an electrically conductive shield 41, for example of braided, foil, or other material, only an end of which is visible in FIG. 3. The cable 13 also includes a drain wire 42 (sometimes also considered part of the shield) used for the standard purpose of maintaining electrical integrity of the shield 41 and being connectable electrically with respect to the contact 31 of the terminator. The shield 41 may be directly connected to the contact 31 or connected thereto via the drain wire as is described further below. Moreover, the cable 13 has an electrical insulation layer 43, which separates the signal conductor 40 from the shield and drain wire 41, 42, and a further electrical insulation layer 44, which also may serve as the outer protective jacket for the cable. The cable 13 is partly and fully stripped in the stepped manner illustrated in FIG. 3 so that the signal conductor 40 protrudes at the leading end of the cable and the shield 41 and drain wire 42 protrude or are exposed axially back of the signal conductor along the cable axis.

Exemplary use of the cable 13 would be the transmission of high speed electrical signals carrying information or data. Such signals are carried on the signal conductor 40, and electrical isolation/shielding therefor ordinarily is provided by the shield 41 and drain wire 42, which typically are coupled to a source of reference potential, such as to a ground. For purposes of this detailed description, then, such exemplary use of the cable 13 will be assumed. However, it will be understood that the cable 13 may be used for other purposes as well.

At the leading end 34 of the assembly terminator 12 is the pin 23 and printed circuit board 20. The pin 23 is supported by the printed circuit board in the manner illustrated in FIG. 3 and preferably is soldered at 45 to a printed circuit trace on the bottom 46 of the printed circuit board 20. Such pin 23 and trace connect the signal conductor 30 to another circuit, for example.

Figure 4:
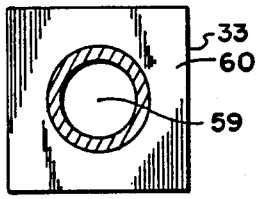
FIG. 4 is a top plan view of the terminator looking generally in the direction of the arrows 4—4 of FIG. 3.

Referring, now, to the individual components of the coaxial cable terminator 12, with reference to the additional figures, FIG. 4 illustrates the top plan view of the strain relief 33 looking along the axis 59 of the terminator 12 and cable 13. The top 60 of the strain relief 33 preferably is square and the sides are vertical, as is seen in FIG. 3, to minimize the cross-sectional size of the strain relief and, therefore, to maximize the number of coaxial cable termination assemblies that can be installed in the common electrically conductive member 11, thus maximizing close packing thereof. Also, since the cross-section of the strain relief is square, as taken along the terminator axis 59, the terminator can be positioned in any of four angularly rotated orientations about the axis 59 while still permitting close packing even in side-by-side relation, e.g. touching one another at the strain relief area.

Figure 6:
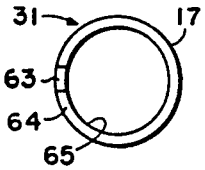
FIG. 6 is an end view of the tubular contact looking in the direction of the arrows 6—6 of FIG. 5.
Figure 5:
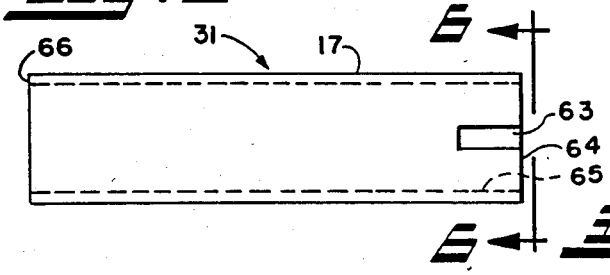
FIG. 5 is a side elevation view of a tubular contact of the terminator of FIG. 3.

As is seen in FIGS. 5 and 6, the second contact 31, which may also be referred to as the ground contact, is in the form of a generally tubular sleeve of hollow cylindrical configuration. The sleeve has a substantial external contact surface 17 intended to engage directly with the wall 18 defining the respective opening 16 in the common electrically conductive member 11 for good electrical contact therewith and for strong mechanical support thereby. An axial slot 63 in the wall of the sleeve 31 at the back end 64 thereof extends from the interior wall 65 to the exterior surface 17 and is provided to facilitate connection with the drain wire 42, and the leading end 66 of the sleeve is intended to be placed in direct confrontation, mechanical abutment, etc., with respect to the top surface 67 of the insulator 22, as is seen in FIG. 3. The sleeve contact 31 provides shielding of the signal contact 30 over the entire length of both contacts. The member 11 also preferably is of a thickness about equal to the distance from the bottom 68 of the strain relief 22 to the leading end 66 of the sleeve contact 31 for optimizing shielding function by actually effecting shielding and by maximizing connection surface between surface 17 and wall 18.

Figure 7:
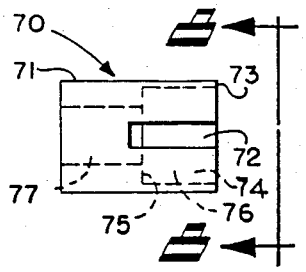
FIG. 7 is a side elevation view of a tubular ring of the terminator.
Figure 8:
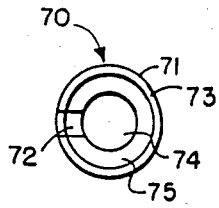
FIG. 8 is an end view of the tubular ring looking generally in the direction of the arrows 8—8 of FIG. 7.

To make the electrical connection between the tubular sleeve ground contact 31 and the shield 41 and drain wire 42, as well as to help secure the mounting of the terminator 12 to the cable 13, while also helping to maintain the desired impedance matching, an electrically conductive ring 70 is employed, as seen in FIGS. 7 and 8. Preferably the ring 70 and the tubular ground contact 31 are formed of the same material to optimize the electrical characteristics thereof and the two preferably fit concentrically. A preferred material would be a metal, such as brass. The ring 70 includes a hollow tubular body 71 having a slot 72 at the back end 73 for passing the drain wire therethrough to the slot 63 in the sleeve contact 31.

An interior passage 74 through the hollow tubular body 71 of the ring 70 is stepped at 75 providing a relatively wide diameter area 76 and a relatively narrower diameter area 77, respectively at the back and leading portions of the ring. The wide diameter area 76 is provided to accommodate the relatively large diameter outer jacket 44 of the coaxial cable 13 with the shield 41 and drain wire 42 preferably urged to abutment with the step 75 for electrical connection therewith while the drain wire 42 is further accessible through the slot 72. The relatively narrower diameter portion 77 through the tubular body 71 accommodates the insulation 43 and signal conductor 40 of the coaxial cable 13. Preferably the ring fits closely to the insulation 44 and 43 at ring portions 76, 77, respectively, to provide relatively secure mechanical connection of the ring and cable. Moreover, it will be appreciated that the looser or sloppier the fit, the less control, consistency and accuracy of impedance characteristics will be possible.

Figure 10:
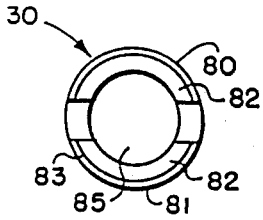
FIG. 10 is an end view of the center/signal contact looking generally in the direction of the arrows 10—10 of FIG. 9.
Figure 9:
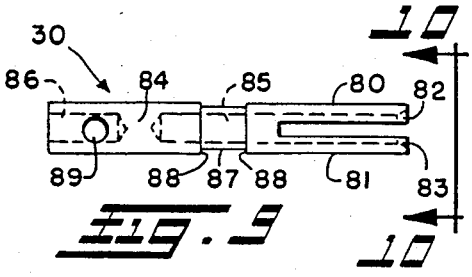
FIG. 9 is a side elevation view of the center/signal contact of the terminator.

The signal contact 30 is shown in detail in FIGS. 9 and 10. The contact 30 includes a pair of contact tines 80, 81, which have an arcuate cross section, as is seen most clearly in FIG. 10, and a sloped or tapered entrance 82 at the leading end 83 of the contact. Overall, the contact 30 is generally elongate hollow tubular shape, as is seen in FIGS. 9 and 10, with the exception that a wall 84 separates the hollow 85 between the tines 80, 81 from the hollow 86 intended to receive the signal conductor 40. A stepped down or narrower recess zone 87 in the outer wall of the contact 30 in the area of the wall 84 is bounded by stepped walls 88 and is provided for locking purposes in the terminator, as is described further below. A solder or spot weld hole 89 through the tubular wall 81 of the contact 30 aligned with the hollow 86 enables soldering or spot welding of the signal conductor 40 directly to the contact 30.

Figure 11:
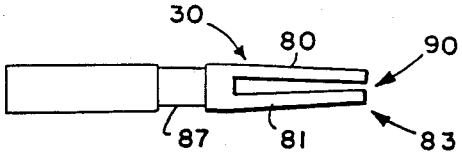
FIG. 11 is a side elevation plan view of the finished center/signal contact with a partly closed entrance tines formation.

As is seen in FIG. 11, the contact 30 is finished in a way that the tines 80, 81 are deformed or bent toward one another at the leading end in order to provide a resiliency characteristic and an interference fit with and wiping of a pin 23 inserted therebetween. Accordingly, by insertion of the pin between the tines by relative axial motion of the contact 30 and pin 23, for example, the pin is guided by the sloped surfaces 82 to the zone 90 between the tines and urges the tines apart. The tines wipe against the pin for good electrical connection therewith. The resiliency of the tines holds that electrical connection and provides mechanical retention between the contact 30 and pin 23.

Figure 12:
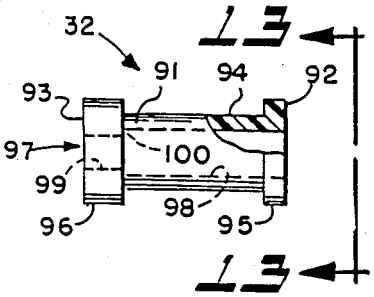
FIG. 12 is a side elevation view, partly in section, of a tubular barbell-shape spacer of the terminator.
Figure 13:
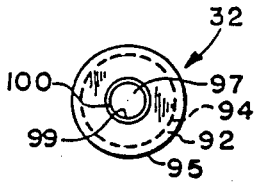
FIG. 13 is an end view of the spacer looking generally in the direction of the arrows 13—13 of FIG. 12.
Figure 14:
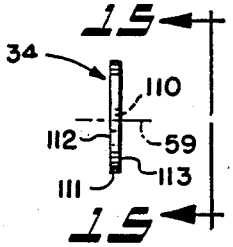
FIG. 14 is a side elevation view of an insulating washer spacer of the terminator.
Figure 15:
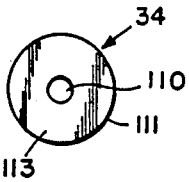
FIG. 15 is an end view of the washer looking generally in the direction of the arrows 15—15 of FIG. 14.

The terminator 12 preferably includes two electrically insulating spacers, one being the generally tubular spacer 32 (FIGS. 12 and 13) and the other being the insulating washer 34 (FIGS. 14 and 15). The tubular spacer 32 is formed of a tubular body 91 of barbell-shape having a leading end or edge 92 and a trailing end or edge 93 with relatively large diameter cross sections proximate each edge and a relatively step-down narrower diameter portion 94 therebetween. An exemplary material for the spacer 32 is Teflon, polytetrafluoroethylene, or similar materials that have physical strength and durability, electrical insulation characteristics, and preferably also have low coefficient of surface friction. The latter facilitates relative sliding of the contacts 30, 31 and spacer 32 during assembly of the terminator, thus facilitating the manufacturing thereof. The exterior surfaces 95, 96 of the larger diameter portions of the spacer 32 preferably mechanically engage or abut the interior wall 66 of the tubular sleeve ground contact 31 for cooperative support of the spacer and contacts, as is seen in FIG. 3. However, it has been found that to match the impedance of the cable, e.g. at 50 ohms, the narrower diameter portion 94 and air (in space 94A) between the same and the tubular sleeve contact 31 are a better match than all Teflon material between the contacts 30, 31, as is the case at the spacer ends 92, 93. The wider ends 92, 93 are provided, though, for cooperating with the contact 31 for structural strength and integrity of the terminator.

The tubular spacer 32 has a hollow interior passage 97 extending axially therethrough. The passage 97 has a relatively wide diameter portion 98 more proximate the leading end thereof and a relatively narrower diameter portion 99 at the opposite end. A step or shoulder 100 joins the two portions 98, 99. The stepped-down or narrower diameter retainer wall portion 99 of the tubular spacer 32 fits in the retention groove 87 of the contact 30 when the contact is force fit axially into the hollow interior of the spacer 32. Such insertion of the contact 30 into the spacer preferably is tines first from the back edge 93 to accomplish a secure fit in the manner illustrated in FIG. 3, for example. The walls defining the contact 30 recess retention groove 87 and those defining the spacer 32 stepped down portion 99 form a shoulder retention mechanism securely to hold the contact in the spacer and the spacer and contact with respect to each other.

The diameter of the relatively wider interior passage 98 in the spacer 32 preferably is wide enough to accommodate resilient opening of the contact tines 80, 81 in response to insertion of a terminal pin 23. However, preferably the walls of the spacer passage 98 limit the maximum size of such terminal pin 23 that can be accommodated and also provide support for the tines to prevent overstressing of the contact tines beyond the elastic limit thereof.

The insulating washer spacer 34, which is illustrated in FIGS. 14 and 15, preferably is of a relatively strong electrically non-conductive material. An exemplary material is one sold under the name Kapton. The washer preferably is relatively thin for optimum impedance matching and size miniaturization purposes. The washer 34 has a hollow passage 110 through the center to pass the signal conductor 40 therethrough and has a circular exterior edge 111 preferably of a diameter that causes the same to engage in abutment with the interior wall 66 of the tubular grounds contact 31, as can be seen most clearly in FIG. 3. The flat surfaces 112, 113 of the washer 34 assure separation of the signal contact 30 from the ring 70 and washer 34 helps to hold the center conductor 40 and contact 30 in spaced away relation from the ring 70 and sleeve contact 31.

Referring back to FIG. 3, now, the assembled terminator 12 is seen. Assembly is accomplished by initially stripping the coaxial cable 13 to the condition illustrated in FIG. 3. The brass ring 70 is inserted into position shown in FIG. 3 preferably engaged with the shield 41, drain wire 42 and insulation layers 43, 44. The shield 41 and drain wire 42 are physically and electrically engaged with the ring. The washer 34 is inserted over the signal conductor 40, as the latter passes through the center opening 110 in the washer. The signal conductor 40 is inserted into the hollow 86 of the signal contact 30, and the two preferably are mechanically and electrically joined by soldering or spot welding at and through the hole 89 (FIG. 9). Alternatively, the contact 30 may be crimped onto the conductor 40. The tubular spacer 32 is slid over the leading edge and tine of the signal contact 30 until the contact retaining shoulder 99 is positioned securely in the retention groove 87 of the contact 30. The tubular ground contact 31 is inserted axially over the tubular spacer 32 toward the cable 13, over the exterior edge 111 of the washer 34, and finally over the brass ring 70. An annular detent 114 formed in the cylindrical wall of the tubular contact 31 cooperates with the wide diameter portion 96 of the tubular spacer 32 to hold the same in axial fixed position. The detent 114 may be a pressed in portion of the metal forming the contact 31, as is shown. More specifically, the detent 114 limits insertion distance of the tubular contact 31 over the spacer 32 and after final assembly with the strain relief molded in place helps prevent withdrawal of the spacer 32 and signal contact 30 from within the tubular contact. The detent 114 also may be formed of the annular detent shown, a series of several discrete detents spaced about the circumference of the contact 31, or even a single discrete detent, as may be necessary to perform the desired function(s).

The slot 72 of the brass ring 70 and the slot 63 of the tubular contact 31 preferably are aligned and the drain wire 42 preferably is exposed in those slots. Moreover, preferably the drain wire is attached to the tubular contact 31 by spot welding, soldering, or other technique for mechanical and electrical integrity of the connection therebetween. Also, spot welding or soldering may be used to secure the ring 70 and contact 31 in the area of the slots 63, 72.

Finally, the strain relief 33 is directly molded about the cable 13 and the back end 115 of the terminator 12. Preferably, the strain relief 33 is formed of plastic, nylon or other electrically insulating material having adequate strength and moldability characteristics as well as electrical impedance and insulating characteristics. Moreover, preferably the strain relief material fills the exposed areas in the slots 72, 63 and the connection of the drain wire 42 to the tubular contact 31. Accordingly, the strain relief forms a hermetic seal and a mechanical retainer vis-a-vis those portions of the terminator. Furthermore, in a most preferred embodiment of the invention, the material of which the strain relief 33 is formed preferably forms a chemical bond with the external jacket 44 of the coaxial cable 13 thereby causing the terminator effectively to become integral with the cable.

Examplary use of the terminator 12 as part of the coaxial cable termination assembly 14 may be to couple high speed electrical signals carried on the signal conductor 40 to the pin 23 while the coaxial cable shield 41, drain wire 42, the tubular ground contact 31 and common electrically conductive member 11 provide adequate shielding isolation function.

The diameters of the contacts 30, 31 and the spacing thereof relative to each other may be computed to achieve the desired impedance match with the cable 13, and the shape of the contacts 30, 31 yields a coaxial configuration and electrical appearance like that of the cable conductors 40, 41. The ring 70 is used both for physical attachment strength and to enable the tubular sleeve contact 31 to be positioned in the desired coaxial relation to the signal contact 30 while also facilitating mechanical and electrical connection of the terminator 12 to the cable 13. The actual impedances and shapes of the spacer, i.e. tubular spacer 32 and washer 34 as well as the air gaps in the terminator provide, in cooperation with the shapes and positions of the contacts 30, 31, the desired impedance matching characteristics, while the shapes in particular help to secure together the several parts of the terminator 12; examples of such securement include the enlarged ends 92, 93 of the tubular spacer 32 abutting the sleeve contact wall 66, the cooperation of the end 93 with the detent 114, the securing of the signal contact 30 in the spacer 32 by the shoulder retainer mechanism 87, 99, etc. Due to the terminator integral strength and electrical characteristics, the size may be minimized, e.g. diameter to facilitate and to optimize closepacked use, etc., and length, to minimize signal transmission distance outside the precise environment of the coaxial cable itself. The leading end 92 of the tubular spacer 32 also closes the space at the leading end of the terminator to prevent undesired foreign matter entering that space. The described interaction of parts and portions of parts of the terminator 12 of the invention provides for accomplishment of the physical size, the electrical properties, and the operation attributes of the invention as is described herein.

We claim:

1. A cable termination assembly comprising a coaxial cable that has a pair of conductors, one being generally centered in the cable relative to the other, the coaxial cable having a characteristic impedance, and a terminator comprising center contact means for connecting between such one generally centered conductor and one external member, second contact means for connecting between such other conductor to an external member, said second contact means generally circumscribing said center contact means along an axial extent of the terminator, spacer means for maintaining electrical isolation and spaced relation of said contact means, said contact means and spacer means being cooperatively interrelated substantially to match the impedance of the coaxial cable, and strain relief means for mechanically securing the terminator to such coaxial cable, said second contact means including a hollow sleeve contact of substantially uniform cross-section and having an interior wall and an exterior wall at least partly exposed for contacting the respective external member, said spacer means including a hollow electrically non-conductive generally tubular spacer having an exterior wall in supporting engagement with said interior wall of said sleeve contact and an interior wall defining a passage extending axially through said tubular spacer, said center contact means including an elongate center contact at least partially contained in said passage and held by said tubular spacer in generally concentric relation to said sleeve contact, said center contact having one end attached and electrically connected to said one conductor of said cable and the other end positioned in concentric relation to said sleeve contact at the leading end of said terminator, said other end being accessible at the leading end of said terminator for coupling with an external member inserted into said terminator in engagement with said other end of said center contact said tubular spacer having an axially outer end portion and a central portion of smaller cross-sectional area than said end portion, said end portion having an interior surface in supporting engagement with said center contact and an exterior surface in engagement with said sleeve contact, and said central portion of said tubular spacer being spaced from one of said center contact and sleeve contact to form an air space axially inwardly of said outer end portion and within the interior of said sleeve contact, wherein said center contact and sleeve contact have respective axially outer ends which are substantially co-terminues, and said outer end portion of said tubular spacer is located at said axially outer ends of said center contact and sleeve contact, said outer end portion of said tubular spacer further comprises a flat end face substantially coplanar with said center contact and said sleeve contact outer end portions and forms a closure between the axially outer ends of said center contact and sleeve contact which prevents foreign matter from entering said air space.

2. The assembly of claim 1, wherein the individual impedance characteristics of each of said contact means and spacer means and respective cross sections along the axial extent of the terminator is substantially uniform.

3. The assembly of claim 1, said coaxial cable including insulation intermediate the conductors thereof and an external insulation jacket, and the terminator including mounting means for physically mounting said second contact on both insulation materials of the cable.

4. The assembly of claim 1, wherein said tubular spacer has an axially inner end portion of greater cross-sectional area than said central portion, and said inner end portion has an interior surface in supporting engagement with said center contact and an exterior surface in supporting engagement with said sleeve contact.

5. The assembly of claim 1, said tubular spacer being a barbell-shape member having relatively larger cross section area ends and a relatively narrower cross section area center portion, said exterior wall of said tubular spacer engaging with said sleeve contact comprising wall portions at said relatively larger cross section area ends of said tubular spacer.

6. The assembly of claim 5, further comprising cooperative shoulder retainer means for retaining said center contact axially positioned in the passage of said tubular spacer.

7. The assembly of claim 6, further comprising detent means in said sleeve contact interior wall for cooperating with at least one of said relatively larger cross section area ends of said tubular spacer to hold said sleeve contact and tubular spacer in relative axial positions.

8. The assembly of claim 1, wherein the coaxial cable includes electrical insulation generally covering the greater extent of such center conductor thereof and separating the latter from the other conductor thereof, and further comprising an electrically conducting ring means at one end of said sleeve contact for electrically connecting said sleeve contact with said other conductor.

9. The assembly of claim 8, wherein said ring means is mounted on said insulation, said ring means is hollow to pass such insulation and central conductor therethrough, and said ring means has an external wall means for engaging with and mounting thereon of said sleeve contact.

10. The assembly of claim 1, wherein said center contact has a pair of tines at said other end thereof for electrically connecting with such external member inserted therebetween.

11. The assembly of claim 10, wherein said tines are substantially fully within said tubular spacer and said interior wall of said tubular spacer backs up said tines for preventing overstressing thereof when an external member is inserted therebetween.

12. The assembly of claim 11, said tubular spacer having a barbell shape with an enlarged end at the leading end of the terminator for closing the space between said center contact and said sleeve contact.

13. The terminator of claim 11, said sleeve contact including detent means for cooperating with said tubular spacer to hold the same in relative position, said spacer being a barbell shape, electrically non-conductive spacer, and said detent cooperating with one of the relatively enlarged ends of said barbell shaped spacer.

14. A coaxial cable termination system comprising the termination assembly of claim 1, and further comprising a common electrically conductive member means having plural openings therein for receiving respective terminators for connection to respective external members by respective center contacts while effecting common connection of said sleeve contacts.

15. The system of claim 14, said common electrically conductive member comprising a metal plate.

16. The system of claim 15, further comprising a printed circuit board, said external member comprising a plurality of terminal pins mounted on said printed circuit board, and means for mounting said common electrically conductive member relative to said printed circuit board with said terminal pins in respective openings of said common electrically conductive member.

17. A terminator for a coaxial cable that has a pair of conductors consisting of an outer conductor and a central conductor generally centered relative to the outer conductor, an inner insulation jacket separating the conductors and an outer insulation jacket covering the outer conductor, comprising:

center contact means for connecting between the central conductor and one external member, second contact means for connecting between the outer conductor and another external member, said second contact means including a hollow tubular contact generally circumscribing said center contact means along an axial extent of the terminator, spacer means for maintaining electrical isolation and spaced relation of said center contact means and tubular contact, strain relief means for mechanically securing the terminator to the coaxial cable, and electrically conducting ring means at one end of said tubular contact for electrically connecting said tubular contact with the outer conductor, said ring means being mounted on the inner insulation jacket, said ring means having an external wall means for engaging with and mounting thereon of said tubular contact, and said ring means having an axial passage stepped to provide a relatively narrow diameter passage portion for engaging with the inner insulation jacket and a relatively larger diameter passage portion for engaging with the outer insulation jacket.

18. The terminator of claim 17, further comprising a first slot in a wall of said ring means and a second slot in a wall of said tubular contact, and said slots being cooperative to provide access to the outer conductor, and connection means for electrically and mechanically fastening the outer conductor to at least one of said ring means and said tubular contact.

19. The terminator of claim 18, said strain relief means comprising electrically non-conductive material molded to and about at least part of such cable, said tubular contact and said ring means, and said strain relief material enclosing said connection means.

20. A coaxial cable termination assembly comprising:

a coaxial cable including a pair of conductors consisting of an outer conductor and a center conductor generally centered relative to the outer conductor, an inner insulation layer intermediate the conductors and an external insulation layer covering the outer conductor; and a terminator including center contact means for connecting between the center conductor and one external member, second contact means for connecting between the outer conductor and another external member, said second contact means including a tubular sleeve contact generally circumscribing said center contact means along an axial extent of the terminator, spacer means for maintaining electrical isolation and spaced relation of said center contact means and tubular sleeve contact, strain relief means for mechanically securing the terminator to said coaxial cable, and mounting means for physically mounting said tubular sleeve contact to both of said insulation layers of said cable, said mounting means including an electrically conducting ring, said ring including an external surface for directly engaging the interior wall of said tubular sleeve, and said ring also including a stepped interior wall surface for engaging with both insulation layers of said cable.

21. The assembly of claim 20, wherein said center conductor of said cable is exposed beyond an end of said inner insulation layer, said center contact means is mechanically attached to said center conductor, and wherein said spacer means includes a tubular spacer positioned between said center contact means and tubular sleeve contact and a circular disc of electrically non-conductive material positioned in abutment with said end of said inner insulation layer and with said ring to assure electrical separation between the center conductor and center contact on the one hand and said ring and tubular sleeve on the other hand.

* * * * *